United States Patent [19]

Wirtgen

[11] 4,387,929

[45] Jun. 14, 1983

[54] MILLING ROLLER MOUNTING SUPPORT ON MILLING MACHINES FOR MILLING ROAD SURFACES

[76] Inventor: Reinhard Wirtgen, Hohner Strasse, 5461 Windhagen, Fed. Rep. of Germany

[21] Appl. No.: 238,378

[22] Filed: Feb. 26, 1981

[30] Foreign Application Priority Data

Dec. 29, 1980 [DE] Fed. Rep. of Germany ..... 3049318

[51] Int. Cl.[3] ..... E01C 23/09

[52] U.S. Cl. ..... 299/39

[58] Field of Search ..... 299/39–41; 404/121, 127

[56] References Cited

U.S. PATENT DOCUMENTS 1,851,875 3/1932 Siegel ..... 299/39 X 3,767,262 10/1973 Pentith ..... 299/39

4,186,968 2/1980 Barton ..... 299/39

*Primary Examiner*—Ernest R. Purser

*Attorney, Agent, or Firm*—Steinberg & Raskin

[57] ABSTRACT

A milling roller mounting support on milling machines for milling road surfaces has a frame vertically adjustable and at right angles relative to the direction of movement provided on the chassis. The milling roller is rotatably supported at its ends in the frame and is driven on one, or both, respectively, sides by means of a motor each. The frame is provided between at least two parallel guide faces arranged one after the other in the direction of movement and is secured to the chassis by two mounting supports, which are vertically adjustable. A lateral shift of the frame is avoided by a nose arranged at right angles relative to the axis of the milling roller, which nose is guided in a vertical groove provided in the chassis.

8 Claims, 6 Drawing Figures

MILLING ROLLER MOUNTING SUPPORT ON MILLING MACHINES FOR MILLING ROAD SURFACES

BACKGROUND OF THE INVENTION

The present invention relates to a milling roller mounting support on milling machines for milling road surfaces comprising a frame vertically adjustable and at right angles relative to the direction of movement provided on the chassis, in which frame the milling roller is rotatably supported at its ends and is driven on one, or both, respectively, sides by means of a motor each.

Milling machines of this kind, which can manipulate as a rule milling widths up to 4 meters, that is one complete highway lane, within one working operation, require relatively great motive powers for driving the milling roller as well as for moving the machine, motive powers which are transferred to the milling roller by mechanical means or by using hydraulic motors.

With a view to the extreme forces to be transferred, the mounting support of the milling roller constitutes a problem considering that the milling roller should, on one hand, be vertically adjustable and should suitably also be mounted laterally inclinable to the chassis but should also so rigidly be secured to the chassis, on the other hand, that no difficulties arise in the transfer of the relatively great forces and vibrations are largely avoided as well.

SUMMARY OF THE INVENTION

The principal object of the invention is to provide a mounting support of the aforedescribed type, which meets the aforedescribed demands.

This problem is solved in accordance with the present invention in that the frame is provided between at least two parallel guide faces arranged one after the other in the direction of movement and is secured to the chassis by means of two mounting supports, which are vertically adjustable.

By these two vertically arranged parallel guide faces, which may extend over the total width of the chassis or are preferably provided only near the two ends of the milling roller on the chassis, the frame with the milling roller supported in it becomes movable in vertical direction, in any other respect however is rigidly secured to the chassis. The two vertically adjustable mounting supports permit the lowering of the milling roller from the transport position into the working position on one hand and by differently adjusting the height vie the two mounting supports, a lateral inclination of the milling roller on the other so that the road surface may be milled to a depth different from one side to the other.

Furthermore, it has shown to be suitable to provide the frame for the mounting support of the milling roller with a nose arranged at right angles relative to the axis of the milling roller, which nose is guided in a vertical groove provided in the chassis.

Such a nose arrests the frame with the milling roller supported therein against lateral shift in the chassis.

Although such nose may be arranged at any location on the width of the frame, it has shown to be particularly suitable to provide the nose in the vertical groove assigned to it in the middle of the milling roller.

In accordance with a particularly advantageous embodiment of the present invention, the frame is guided between two parallel guide faces each provided one after the other near the ends of the milling rollers in the direction of movement and is secured to the chassis by two mounting supports, which are vertically adjustable, and in one of the guide faces a vertical groove is provided, in which a nose provided at right angles relative to the axis of the milling roller is guided.

Such an embodiment as in accordance with the invention avoids also a lateral shift of the frame and the milling roller guided therein while no particular vertical guide groove has to be provided on the chassis so that the production costs are rather substantially decreased.

The nose may be of any shape provided that it is safely secured in the vertical groove against lateral shift. In cases however where the height adjustment of the milling roller is different on one side relative to the other, however, it has shown to be suitable if the nose has a circular cross section and thus permits a lateral inclination of the frame also in case of a very tight fit within the vertical groove.

In accordance with a particularly advantageous embodiment of the present invention, the nose is supported in a slide block movably guided within the vertical groove.

Such a slide block consists of a metal block preferably cubic-shaped in which a corresponding bore is provided to receive the nose.

By providing the parallel guide faces on one hand and securing the nose in the vertical groove, the frame and thus the milling roller are guided in the chassis safe against any lateral shift while on the other hand the frame and thus also the milling roller may easily be moved from the transport position into the working position via the height-adjustable mounting supports and by differently adjusting the two mounting supports, any desired lateral inclination of the milling roller may be obtained.

It has been shown to be particularly suitable to construct the two vertically adjustable mounting supports for the frame as hydraulic lifting cylinders. The latter may in this way easily be actuated by means of the hydraulic system already available and may further-on be remote-controlled from the driver's seat.

In accordance with a further advantageous embodiment of the present invention, the two vertically adjustable mounting supports are constructed as winding screws. Such winding screws may either be actuated by hand, or they may be constructed as motor-actuated winding screws, which are either actuated by an electrically driven electro motor provided with a worm gear or by a hydraulic motor correspondingly constructed. In the two latter cases, height-adjustment via the winding screws may self-evidently also be remote-controlled from the driver's seat.

The milling roller is suitably driven via hydraulic motors, which are correspondingly adapted and which are directly provided within the milling roller mounting support of the frame.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
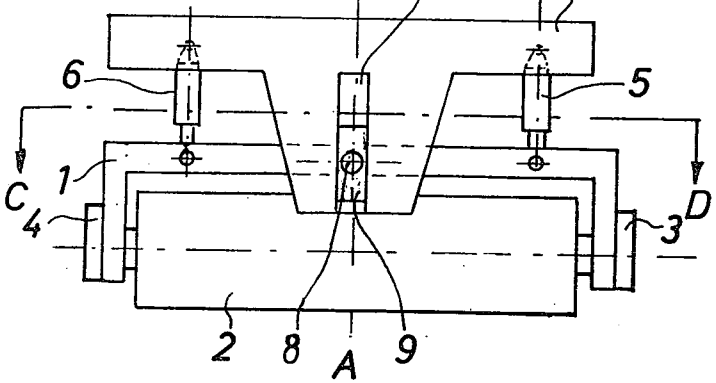
FIG. 1 is a lateral view of an embodiment of the milling roller mounting support of the invention, as seen from the front.

The milling roller mounting support shown in FIG. 1 comprises a U-shaped frame 1 at the ends of which milling roller 2 is rotatably supported in corresponding bearings and wherein hydraulic motors 3 and 4, respectively, are provided at the bearings of each side of the frame to drive milling roller 2.

Frame 1 is secured to chassis 7 of the milling machine via height-adjustable suspensions 5 and 6. To avoid lateral shift of frame 1, the frame is provided with a nose 8, which is rotatably supported within a slide block 9, which on its part is height-adjustably supported within a longitudinal groove 10 provided in the chassis 7.

Figure 2:
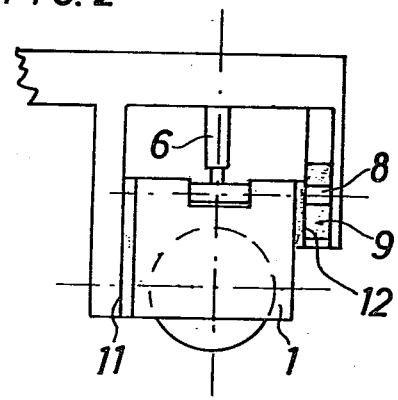
FIG. 2 is a cross-sectional view of the milling roller mounting support of FIG. 1, taken along the lines A-B, of FIG. 1.

As may particularly be seen from FIG. 2, frame 1 is guided between at least two parallel guide faces 11 and 12 of the chassis arranged one after the other in the direction of the movement, and the milling roller may in this way be adjusted in any height relative to the chassis by means of height-adjustable mounting supports 5 and 6. By differently adjusting the two height-adjustable mounting supports 5 and 6, any desired inclination of the milling roller may be obtained. Slide block 9 guided within groove 10 avoids shifting of the milling roller in lateral directions.

Figure 3:
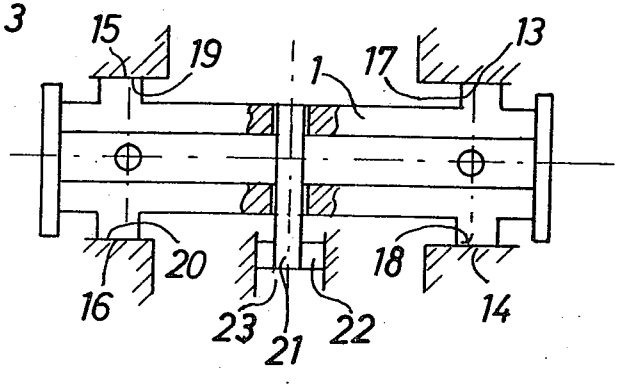
FIG. 3 is a sectional view of another embodiment of the milling roller mounting support of the invention, taken along the lines C-D, of FIG. 1.

FIG. 3 is a sectional view of a different embodiment of the milling roller mounting support of the invention, wherein parallel guide faces 13, 14 and 15, 16, respectively, arranged one after the other, each are provided near the milling roller mounting supports at the ends, while sliding faces 17 and 18, and 19 and 20, respectively, corresondingly shaped and provided on the frame cooperate with the guide faces of the chassis and thus provide for the necessary stabilization of frame 1 and milling roller 2, respectively, in the chassis. Nose 21 provided in frame 1 is rotatably supported in frame 1 on one hand, and in slide block 22, on the other. The slide block 22 is vertically adjustable within vertical groove 23 provided in the chassis.

As may be seen in FIGS. 1 and 2, vertically adjustable mounting supports 5 and 6 are tiltingly supported on frame 1 so that a different height adjustment, and thus an inclined position of the milling roller, is made possible without any difficulties.

Figure 6:
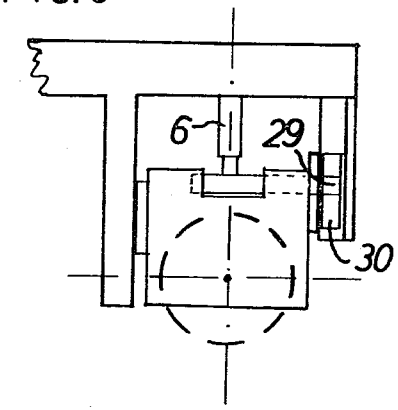
FIG. 6 is a cross-sectional view of the milling roller mounting support of FIG. 4, taken along the lines G-H, of FIG. 5.
Figure 4:
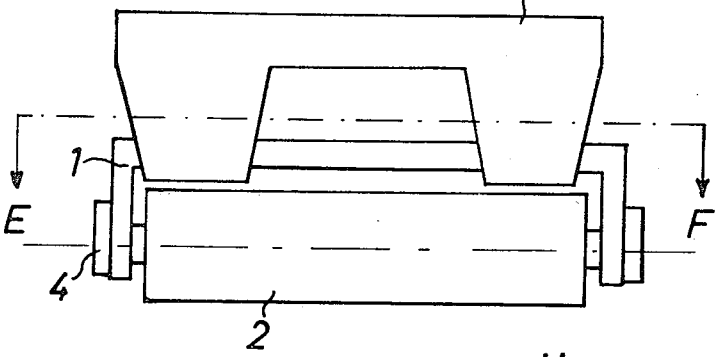
FIG. 4 is a lateral view of another embodiment of the milling roller mounting support of the invention as seen from the front.
Figure 5:
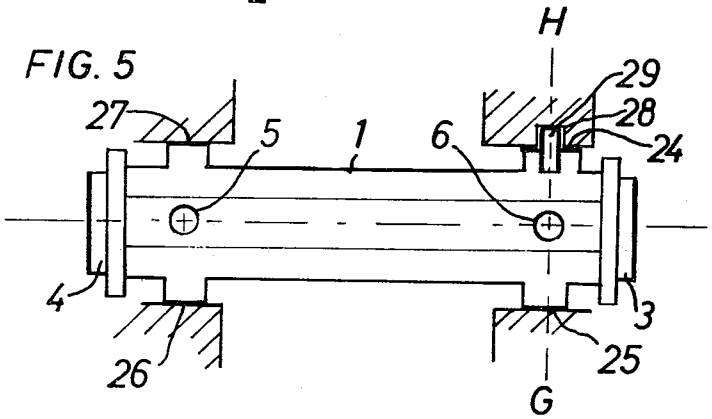
FIG. 5 is a sectional view of the milling roller mounting support of FIG. 4, taken along the lines E-F, of FIG. 4.

In the particularly advantageous embodiment of the present invention shown in FIGS. 4 to 6, frame 1 is guided within two parallel guide faces 24, 25, and 26, 27 each arranged one after the other in the direction of movement near the ends of the milling roller and is secured by means of two height-adjustable mounting supports 5 and 6 to the chassis 7. A vertical longitudinal groove 28 is provided in the guide face 24, wherein a nose 29 provided at right angles relative to the axis of the milling roller is guided.

As shown in FIG. 6, nose 29 is supported in a slide block 30 slidingly guided within vertical groove 28.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A milling roller mounting support for milling machines used for milling road surfaces, said milling roller having an axis and spaced opposite axial ends and said mounting support comprising a chassis having two substantially parallel guide surfaces located behind each other in the direction of movement, said chassis having a substantially vertical groove formed in a surface thereof;

a pair of vertically adjustable supports mounted on said chassis; and a frame positioned at substantially right angles to the direction of movement and supported in said chassis by said supports in a manner whereby said frame is guided by said guide surfaces, wherein said milling roller is tiltingly supportable at its end via said supports, said frame having a nose extending substantially at right angles to the axis of said milling roller and extending into said groove of said chassis for guiding said frame.

2. A milling roller mounting support as claimed in claim 1, wherein said nose and said groove are positioned substantially midway between said axial ends of said milling roller.

3. A milling roller mounting support as claimed in claim 1, wherein said guide faces are positioned near said axial ends of said milling roller and said groove is formed in one of said guide faces.

4. A milling roller mounting support as claimed in claim 1, wherein said nose has a substantially circular cross-section.

5. A milling roller mounting support as claimed in claim 1, further comprising a slide block slidably mounted in said groove and wherein said nose is supported in said slide block.

6. A milling roller mounting support as claimed in claim 1, wherein said supports comprise hydraulic lifting cylinders for said frame.

7. A milling roller mounting support as claimed in claim 1, wherein said supports comprise winding screws for said chassis.

8. A milling roller mounting support as claimed in claim 7, wherein said winding screws are motor-actuated.

* * * * *